US006822580B2

(12) United States Patent
Ewing et al.

(10) Patent No.: US 6,822,580 B2
(45) Date of Patent: Nov. 23, 2004

(54) EMERGENCY VEHICLE WARNING SYSTEM

(76) Inventors: Jimmie L. Ewing, P.O. Box 440541, Aurora, CO (US) 80044; Stanley T. Zubiel, P.O. Box 1184, Monument, CO (US) 80132

( * ) Notice: Subject to any disclaimer, the term of this patent is extended or adjusted under 35 U.S.C. 154(b) by 0 days.

(21) Appl. No.: 09/825,259

(22) Filed: Apr. 3, 2001

(65) Prior Publication Data

US 2002/0008635 A1 Jan. 24, 2002

Related U.S. Application Data

(63) Continuation-in-part of application No. 09/307,513, filed on May 7, 1999, now abandoned.

(51) Int. Cl.[7] ..... G08G 1/00
(52) U.S. Cl. ..... 340/902; 340/901; 180/167
(58) Field of Search ..... 340/902, 901, 340/903, 993; 180/167

(56) References Cited

U.S. PATENT DOCUMENTS 3,158,835 A * 11/1964 Hipkins ..... 340/384.73
3,986,119 A * 10/1976 Hemmer et al. ..... 340/286.13
4,626,850 A * 12/1986 Chey ..... 340/903
4,706,086 A * 11/1987 Panizza ..... 180/167
4,747,064 A * 5/1988 Johnston ..... 340/870.15
4,952,931 A * 8/1990 Serageldin et al. ..... 340/901
5,126,735 A * 6/1992 Trevijano ..... 340/901
5,739,767 A * 4/1998 Carr ..... 340/901
5,767,793 A * 6/1998 Agravante et al. ..... 180/167

* cited by examiner

*Primary Examiner*—John Tweel

(57) ABSTRACT

A warning system for alerting the driver of a private vehicle that an emergency vehicle is approaching. The system includes a receiver and a display panel mounted in the private vehicle, and at least two infrared receivers mounted on the private vehicle. The display panel mounted in the private vehicle including indicating devices that allow the driver of the private vehicle to know of the approaching emergency vehicle as well as the direction to move in order to yield the right of way to an approaching emergency vehicle; and a warning signal emitting device mounted in the emergency vehicle, the warning signal emitting device providing signals that allow the components of the emergency vehicle warning system mounted in the private vehicle to know that the approaching vehicle is an emergency vehicle.

6 Claims, 17 Drawing Sheets

SYSTEM CONFIGURATION

Transmit Message Structure

Receiver/Antenna Interface

Reciever Antenna Bloc k Diagram

Receiver Block Diagram

Receiver Message Processing

Receiver Front Panel Display

| LED LOCATION | X POLARITY | Y POLARITY | [X] vs. [Y] |
|---|---|---|---|
| FRONT | + OR - | + | X < Y |
| FRONT/RIGHT | + | + | X ≈ Y |
| RIGHT | + | + OR - | X > Y |
| RIGHT/BACK | + | - | X ≈ Y |
| BACK | + OR - | - | X < Y |
| BACK/LEFT | - | - | X ≈ Y |
| LEFT | - | + OR - | X > Y |
| LEFT/FRONT | - | + | X ≈ Y |

LED Lighting Table

FIG. 14

| PART NUMBER | DESCRIPTION | MFGR | SOURCE | REF. DES. | QTY |
|---|---|---|---|---|---|
| LM78L05ACM | Voltage regulator, +5V, 100 mA (SO-8) | National | Digi-Key | U1 | 1 |
| MC13176D | IC, UHFAM/FM transmitter (SO-8) | Motorola | Future Active | U3 | 1 |
| PIC12C508-04/P | IC, microcontroller, programmed | Microchip Technology | Digi-Key | U2 | 1 |
| BCW61D | Transistor, PNP, small signal (SOT-23) | Zetex | Digi-Key | Q1 | 1 |
| BAS16LT1 | Diode, switching, 150 mA (SOT-23) | Motorola | Newark | CR1 | 1 |
| EX45AG32@13.56875 | Crystal, 13.56875 MHz, fundamental (HC-45/U) | ICM | ICM | Y2 | 1 |
| ECS-40-20-5P | Crystal, 4.0000 MHz, fundamental (HC-49/SMD) | ECS | Digi-Key | Y1 | 1 |
| 492S-1055A | Filter, helical resonator, 2 pole, 435 MHz (5CHW) | Toko | Digi-Key | FL1 | 1 |
| E558AN-100044 | Inductor, .072 uH, adjustable, SMD, MC152 | Toko | Digi-Key | L2 | 1 |
| ELJ-FAR22MF2 | Inductor, .22 uH, 20% (1210) | Panasonic | Digi-Key | L1 | 2 |
| ECE-V1CA100SR | Capacitor, tant., 10 uF, 16V (SMT-B case) | Panasonic | Digi-Key | C5 | 1 |
| ECJ-2YB1H104K | Capacitor, ceramic, X7R, .1 uF, 50V (0805) | Panasonic | Digi-Key | C1, C6, C7 | 3 |
| ECU-V1H103KBG | Capacitor, ceramic, X7R, .01 uF, 50V (0805) | Panasonic | Digi-Key | C4, C14 | 2 |
| ECU-V1H102KBN | Capacitor, ceramic, 1000 pF, X7R, 10%, 50V (0805) | Panasonic | Digi-Key | C8 | 1 |
| ECU-V1H561KBN | Capacitor, ceramic, 560 pF, X7R, 10%, 50V (0805) | Panasonic | Digi-Key | C15 | 1 |
| ECU-V1H331JCG | Capacitor, ceramic, 330 pF, NPO, 5%, 50V (0805) | Panasonic | Digi-Key | C13 | 1 |
| ECU-V1H151JCG | Capacitor, ceramic, 150 pF, NPO, 5%, 50V (0805) | Panasonic | Digi-Key | C11, C12 | 2 |
| ECU-V1H390JCG | Capacitor, ceramic, 39 pF, NPO, 5%, 50V (0805) | Panasonic | Digi-Key | C10 | 1 |
| ECU-V1H270JCG | Capacitor, ceramic, 27 pF, NPO, 5%, 50V (0805) | Panasonic | Digi-Key | C2, C3 | 2 |
| GKG20067-07 | Capacitor, trimmer, 4.5-20 pF, N750 (SMT) | Sprague | Digi-Key | C9 | 1 |
| ERJ-6GEYJ134 | Resistor, 130K, 5%, 1/10W (0805) | Panasonic | Digi-Key | R7 | 1 |
| ERJ-6GEYJ273 | Resistor, 27K, 5%, 1/10W (0805) | Panasonic | Digi-Key | R3, R12 | 2 |
| ERJ-6GEYJ203 | Resistor, 20K, 5%, 1/10W (0805) | Panasonic | Digi-Key | R9 | 1 |
| ERJ-6GEYJ183 | Resistor, 18K, 5%, 1/10W (0805) | Panasonic | Digi-Key | R6 | 1 |
| ERJ-6GEYJ103 | Resistor, 10K, 5%, 1/10W (0805) | Panasonic | Digi-Key | R10 | 1 |
| ERJ-6GEYJ822 | Resistor, 8.2K, 5%, 1/10W (0805) | Panasonic | Digi-Key | R13 | 1 |
| ERJ-6GEYJ621 | Resistor, 620 ohm, 5%, 1/10W (0805) | Panasonic | Digi-Key | R1, R4 | 2 |
| ERJ-6GEYJ510 | Resistor, 51 ohm, 5%, 1/10W (0805) | Panasonic | Digi-Key | R5 | 1 |
| ERJ-8GEYJ180 | Resistor, 18 ohm, 5%, 1/8W (1206) | Panasonic | Digi-Key | R2 | 1 |
| 2-640463-3 | Socket, IC, 8 pin | Amp | Digi-Key | (U2) | 1 |
| 1731-832-A-0-1/4 | Rod, antenna, 6 3/4" long, 8-32 threaded | RAF | | | 1 |
| | Printed circuit board | | | | 1 |
| 110-I-BLACK | Case, plastic, 2.25" x 3.60" x 0.995" | Serpac | Digi-Key | | 1 |

Fig. 19

| PART NUMBER | DESCRIPTION | MFGR | SOURCE | REF. DES. | QTY |
|---|---|---|---|---|---|
| LM78L05ACM | Voltage regulator, +5V, 100 mA (SO-8) | National | Digi-Key | U1 | 1 |
| LM78L05ACD | Voltage regulator, +9V, 100 mA (SO-8) | ST Microelectronics | Mouser Electronics | U2 | 1 |
| RF2411 | IC, LNA/mixer, GaAs FET (SOP-14) | RF Micro Devices | RF Micro Devices | U3 | 1 |
| MC13176D | IC, UHFAM/FM transmitter (SO-8) | Motorola | Future Active | U4 | 1 |
| TDA1072AM | IC, AM receiver | Philips | Future Active | U5 | 1 |
| LM392M | IC, Op-Amp/comparator (SO-8) | National | Digi-Key | U6 | 1 |
| PIC16C710-04/P | IC, microcontroller, programmed | Microchip Technology | Digi-Key | U7 | 1 |
| MMBR3906 | Transistor, PNP, switching (SOT-23) | Motorola | Digi-Key | Q2 | 2 |
| BCW61D | Transistor, PNP, small signal (SOT-23) | Zetex | Digi-Key | Q1 | 1 |
| BAS16LT1 | Diode, switching, 150 mA (SOT-23) | Motorola | Newark | CR1 | 1 |
| 351-5111 | LED, red, diffused, T-1 3/4 | | Mouser Electronics | CR2-CR9 | 8 |
| EX45AG32@12.900 | Crystal, 12.900 MHz, fundamental (HC-45/U) | ICM | ICM | Y1 | 1 |
| CCL-SM3-21.855-F22F | Crystal, 21.855 MHz, fundamental (HC-49/SMD) | Cal Crystal | Cal Crystal | Y2 | 1 |
| ECS-40-20-5P | Crystal, 4.0000 MHz, fundamental (HC-49/SMD) | ECS | Digi-Key | Y3 | 1 |
| 492S-1055A | Filter, helical resonator, 2 pole, 435 MHz (5CHW) | Toko | Digi-Key | FL1, FL2 | 2 |
| 21M30B | Filter, crystal, 4 pole, 21.4 MHz | Fox Electronics | Fox Electronics | FL3 | 1 |
| RMC202313NO | Transformer, 455 KHz (10EZC) | Toko | Digi-Key | T1 | 1 |
| E558AN-100044 | Inductor, .072 uH, adjustable, SMD, MC152 | Toko | Digi-Key | L5 | 1 |
| ELJ-FAR22MF2 | Inductor, .22 uH, 20% (1210) | Panasonic | Digi-Key | L1 | 2 |
| 78FR22K | Inductor, .22 uH, 10% | J.W. Miller | Digi-Key | L4 | 1 |
| 303AN-1101 | Inductor, 1.2 uH, 4%, adjustable (5CD) | Toko | Digi-Key | L2, L3 | 2 |
| 78F270J | Inductor, 27 uH, 5% | J.W. Miller | Digi-Key | L6 | 1 |
| ELJ-FA1R5KF | Inductor, 1.5 uH, 10%, (1210) | Panasonic | Digi-Key | L7 | 1 |
| NRC156K10 | Capacitor, tant., 15 uF, 10V (SMT-C case) | NEC | Mouser Electronics | C2, C24, C43 | 3 |
| ECE-V1CA100SR | Capacitor, tant., 10 uF, 16V (SMT-B case) | Panasonic | Digi-Key | C14 | 1 |
| ECS-T1AY475R | Capacitor, tant., 4.7 uF, 10V (SMT-A case) | Panasonic | Digi-Key | C33, C34 | 2 |
| ECS-T1AY225R | Capacitor, tant., 2.2 uF, 10V (SMT-A case) | Panasonic | Digi-Key | C37 | 1 |
| ECJ-2YB1C334K | Capacitor, ceramic, X7R, .33 uF, 16V (0805) | Panasonic | Digi-Key | C32 | 1 |
| ECJ-2YB1H104K | Capacitor, ceramic, X7R, .1 uF, 50V (0805) | Panasonic | Digi-Key | C1, C15, C16, C25, C27, C28, C38, C39 | 8 |
| ECU-V1H103KBG | Capacitor, ceramic, X7R, .01 uF, 50V (0805) | Panasonic | Digi-Key | C9, C23, C26, C35 | 4 |
| ECU-V1H222KBN | Capacitor, ceramic, 2200 pF, X7R, 10%, 50V (0805) | Panasonic | Digi-Key | C36 | 1 |
| ECU-V1H102KBN | Capacitor, ceramic, 1000 pF, X7R, 10%, 50V (0805) | Panasonic | Digi-Key | C3, C4, C6, C19, C42 | 5 |
| ECU-V1H561KBN | Capacitor, ceramic, 560 pF, X7R, 10%, 50V (0805) | Panasonic | Digi-Key | C5, C7, C8, C11, | 4 |
| ECU-V1H331JCG | Capacitor, ceramic, 330 pF, NPO, 5%, 50V (0805) | Panasonic | Digi-Key | C22 | 1 |
| ECU-V1H151JCG | Capacitor, ceramic, 150 pF, NPO, 5%, 50V (0805) | Panasonic | Digi-Key | C20, C21 | 2 |
| ECU-V1H470JCG | Capacitor, ceramic, 47 pF, NPO, 5%, 50V (0805) | Panasonic | Digi-Key | C10 | 1 |
| ECU-V1H390JCG | Capacitor, ceramic, 39 pF, NPO, 5%, 50V (0805) | Panasonic | Digi-Key | C18 | 1 |
| ECU-V1H330JCG | Capacitor, ceramic, 33 pF, NPO, 5%, 50V (0805) | Panasonic | Digi-Key | C31 | 1 |

Fig. 20

EMERGENCY VEHICLE WARNING SYSTEM

REFERENCE TO RELATED APPLICATIONS

This application is a continuation in part of my application having Ser. No. 09/307,513, filed May 7, 1999, now abandoned, incorporated herein in its entirety by reference.

BACKGROUND OF THE INVENTION (a) Field of the Invention

This invention generally relates to a system for warning drivers of a vehicle of an approaching emergency vehicle, such as an ambulance, police car, or fire truck. More particularly, but not by way of limitation, to a device that detects the presence and approximate location of an approaching emergency vehicle and advises the driver or user on how to avoid the emergency vehicle.

(b) Known Art

Emergency vehicles, such as ambulances, police cars, or fire trucks, typically carry a loud siren and flashing lights to warn motorists and other people on the road that the emergency vehicle needs the right of way. Unfortunately, however, many private vehicles are well insulated and include stereo systems which can fill the interior of the vehicle with sound such that the siren of the emergency vehicle becomes inaudible to the driver of the private vehicle. Furthermore, today's highways and streets often include many lanes. When an emergency vehicle is traveling down one of these multi-lane roadways, it is often very difficult for the driver of the private vehicle to determine the relationship of the emergency vehicle relative to the private vehicle, such that the driver of the private vehicle can make a clear decision as to what to do to safely yield the right of way to the emergency vehicle. For example, in certain situations it may be prudent to pull over to the right of the roadway, while in other situations, it may be safer to pull over to the center or left side of the roadway. In order to make the decision of what is the safest action in yielding the right of way, it is important to know the position and direction of advancement of the approaching emergency vehicle relative to the private vehicle.

Known devices used for warning of an approaching emergency vehicle often use electromagnetic or acoustic waves to allow the emergency vehicle to communicate with the private vehicle. For example, in U.S. Pat. No. 4,747,064 to Johnston, a device which uses an electromagnetic pulse and an acoustic pulse receiver. The Johnston device uses the sound waves to determine the speed of the approaching emergency vehicle, so that the time left until the vehicles meet can then be calculated. An important limitation of the Johnston device is that it only provides information as to how much time is left until the approaching emergency vehicle and the private vehicle meet. This leaves the driver of the private vehicle guessing as to the direction of approach of the emergency vehicle. Perhaps of more importance is that, without knowing the direction of approach, the Johnston system does not help the driver of the private vehicle in deciding the direction towards which he should pull over to yield the right of way to the oncoming emergency vehicle.

Another known solution at warning about an oncoming emergency vehicle is taught in U.S. Pat. No. 4,238,778 to Ohsumi. The Ohsumi device warns the driver of the private vehicle by way of an audible signal. The audible signal intensifies or increases in volume as the emergency vehicle approaches the private vehicle. Additionally, a system for reducing interfering sound signals within the private vehicle is also included. This system lowers the sound volume of devices such as the private vehicle's radio, fan or other noisy device within the vehicle.

Still another approach at the problem associated with warning drivers of an approaching emergency vehicle is taught in U.S. Pat. No. 3,854,119 to Friedman et al. The Friedman device is tuned to a particular radio signal which is used as a communication link between the emergency vehicle and the private vehicle. Thus the Friedman approach, like other known approaches, boosts the ability of the emergency vehicle to warn the private vehicle of the proximity of the emergency vehicle, but does not help the driver of the private vehicle in deciding on which direction to move in order to yield the right of way to the emergency vehicle.

Thus, there remains a need for an emergency vehicle warning system that alerts drivers of private vehicles that an approaching emergency vehicle is in the area. Still further, there remains a need for an emergency vehicle warning system that allows the driver of the private vehicle to determine the direction of approach of the emergency vehicle as well as helping the driver of the private vehicle to determine the safest direction to pull over to yield the right of way to the approaching emergency vehicle.

SUMMARY

It has been discovered that the problems left unanswered by known warning systems can be solved by providing an emergency vehicle warning system that provides the driver of a private vehicle with information on the direction of approach of the oncoming emergency vehicle as well as the direction that the driver should pull over to yield the right of way to the approaching emergency vehicle. The disclosed emergency vehicle warning system includes:

1) a receiver and a display panel mounted in the private vehicle, and at least two infrared receivers mounted on the private vehicle. The display panel mounted in the private vehicle including indicating devices that allow the driver of the private vehicle to know of the approaching emergency vehicle as well as the direction to move in order to yield the right of way to an approaching emergency vehicle; and
2) a warning signal emitting device mounted in the emergency vehicle, the warning signal emitting device providing signals that allow the components of the emergency vehicle warning system mounted in the private vehicle to know that the approaching vehicle is an emergency vehicle.

According to a highly preferred embodiment of the invention the system uses a set of infrared transmitters as well as a set of infrared receivers. The infrared transmitters will be used to determine the proximity of adjacent vehicles or obstacles in order to locate a path for driving the private vehicle in yielding the right of way to the emergency vehicle. The infrared receivers are used to gather the reflected signals that emanated from the transmitters. Also, the receivers will allow the system to respond to an identification signal sent by the emergency vehicle.

The identification signal sent by the emergency vehicle will prompt the system to activate and determine the direction of approach of the emergency vehicle and the relative speed to the approaching emergency vehicle. The direction of approach is determined by the difference in time at which each of the receivers detected a pulsed identification signal sent from the emergency vehicle. The speed will the be determined by using the Doppler shift to calculate the speed of the approaching emergency vehicle.

Another example of an emergency vehicle warning system taught herein is described below. This example uses radio frequency signals and an antenna arrangement that is mounted on the private vehicle to determine the direction of approach of the emergency vehicle. This example is as follows:

1.0 General Description

The Emergency Vehicle Warning System is a radio frequency (RF) based electronic system designed to alert motorists of the presence of a nearby emergency vehicle responding to an urgent situation. The emergency vehicle, using a specially designed transmitter, sends out a low power RF signal so that automobiles in the area equipped with a companion receiver can detect its presence.

The motorist is alerted by an audio tone when the transmission is detected by their receiver. The approximate direction of the emergency vehicle from the motorist is then visually displayed by illuminating one of eight circularly positioned light emitting diodes (LEDs) on the receiver. The maximum operating range for the system is approximately 500 feet. The equipment is intended to be operated without a license under Part 15 of the FCC rules.

2.0 Transmitter Discription

The transmitter operates on a fixed RE frequency in the UHF band. It is normally powered from the emergency vehicle's battery, and begins transmitting as soon as it is energized. According to FCC rules, the transmitter may be operated continuously during the emergency condition. The transmitted signal consists of a one second message that is constantly repeated. The message comprises a 150 mS digital recognition code followed by a period of unmodulated carrier (CW). Using digital AM modulation, the recognition code uniquely identifies the transmission as part of the Emergency Vehicle Warning System. The CW portion of the transmission lasts for 850 ms, to permit the receiver to measure the direction of the transmitted signal. A digital microcontroller, located internal to the transmitter, generates the transmitted message.

3.0 Receiver/Antenna Description

The receiver is located in the motorists vehicle and operates together with a special direction finding antenna mounted on the roof. Interconnecting cables between the receiver and antenna are used to route the received signal output and control signal inputs. FIG. 9 is a block diagram of the receiver/antenna interface. Normally, when no emergency transmission is present, the receiver is constantly listening for the beginning of a transmission from the emergency vehicle. A digital microcontroller performs this function. During this period, the antenna is configured as an omni-directional monopole to permit equal reception from all directions.

After the AM recognition code is successfully detected, the antenna is configured for Y-direction measurement (front-back) and then for X-direction measurement (left-right) during the remainder of the one second transmission. A low frequency, square-wave tone signal is generated by the receiver to effectively produce AM modulation on the received CW carrier and enable directional information to be extracted from the emergency transmission. The antenna then reverts back to the message reception mode, repeating the cycle continuously.

Because the receiver/antenna system is designed to operate only with the expected signal format of the emergency transmitter, it essentially synchronizes itself with it. This minimizes false alarms and allows direction measurements to be performed only while a valid signal is present.

3.1 Antenna Description

The receiver antenna consists of a five element Adcock array. Two elements are used for X-directional measurement, two for Y-directional measurement and one for "sense" measurement. The sense antenna, located in the center of the array, is used for omni-directional message reception and to resolve the 1800 ambiguity that would otherwise result during direction measurement. The antenna system operates under control of the receiver, via interconnecting cables.

While the receiver is listening for a valid recognition code, the TONE input is disabled, effectively disabling the multiplier. Under this condition, RF signals from the sense antenna only are fed to the receiver. During Y-direction measurement, the X-Y control input configures the RF switches to select the front and back antennas, forming a Y-axis dipole antenna pattern. While the Y-axis antennas are selected, a 1 KHz square wave TONE signal is generated which in turn produces a double-sideband suppressed carrier AM signal at the output of the multiplier. The output of the sense antenna is added in quadrature to produce a conventional AM modulated signal. The percentage and polarity of the AM signal are directly related to the direction of the incident RF signal from the emergency transmitter. Alternately, when the polarity of the X-Y control signal is reversed, the left and right antennas are selected, permitting direction finding in the X-axis.

4.0 Receiver Description

A single frequency, superhetrodyne AM receiver is used. It processes recognition decoding and direction finding signals using the same circuitry. An integrated circuit microcontroller performs the timing, control, and direction processing functions.

Automatic gain control (AGC) of the iF stages is necessary to maintain the amplitude linearity required to properly demodulate the AM signals over wide input signal variations. The choice of AGC time constant is a compromise between response time and signal distortion. A fast acting AGO is desirable in order to track rapidly changing RF signal levels. However, if the response time is too quick, the desired AM signals will be "tracked out", causing loss of information. A response time of approximately 50 ms is a reasonable compromise.

As mentioned earlier, the receiver's microcontroller is designed to detect and demodulate the emergency transmitter signal. In the absence of an input signal, the receiver is constantly examining the AM detector output for the presence of a start bit, indicating the beginning of a valid transmission. When the recognition code has been successfully received, the direction finding processing begins. Then, the audio alarm is activated and the appropriate LED is illuminated to indicate the approximate direction of the emergency vehicle from the motorist. At the end of each message, the audio and LED indications are turned off until the next repeated message is processed. In this manner the audio beeps and the LED blinks. FIG. 12 describes the sequence of events during the processing of each transmission.

An analog to digital converter (A/D) in the receiver microcontroller measures the detected AM voltages during the OW portion of the transmitted message and performs the averaging and signal level comparisons necessary to predict the approximate direction of the emergency transmitter. One of the eight possible LEDs will be lit as a result of this measurement.

The results of the direction finding measurements can be summarized in a table that indicates how one of the eight LEDs is illuminated as a function of the X and Y AM levels and polarities. FIG. 14 illustrates such a table.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which:

FIG. 14 illustrates the logic and lighting of the LEDs illustrated in FIG. 13 to provide direction information.

FIG. 19 is a components parts list for the accompanying drawings.

FIG. 20 is a components parts list for the accompanying drawings.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
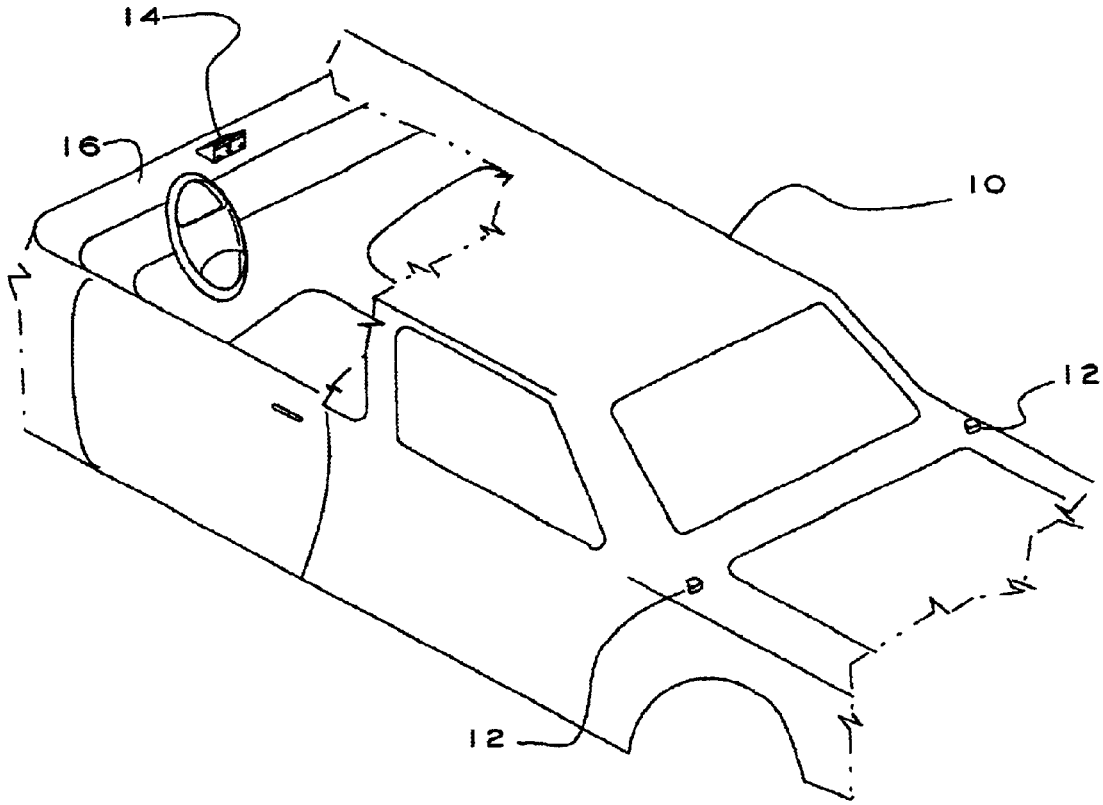
FIG. 1 is a perspective view of a highly preferred embodiment of the components of the invention that are mounted on the private vehicle.
Figure 2:
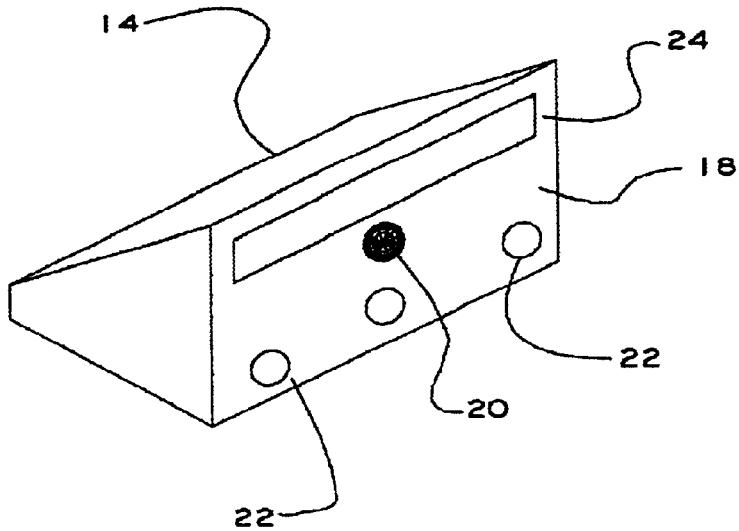
FIG. 2 is a perspective view of an embodiment of a display panel and console that mounts in the private vehicle.

Turning now to FIGS. 1 and 2 where a private vehicle 10 has been illustrated including a pair of infrared transmitters and receivers 12. The transmitter and receivers 12 are functionally electrically connected to a console 14 which preferably mounts on the dashboard 16 of the private vehicle 10.

The console 14 illustrated in FIG. 2 includes a display means which includes means for informing the driver of the private vehicle that an emergency vehicle is approaching. In a highly preferred embodiment of the invention these means for informing the driver of the private vehicle 10 that an emergency vehicle is approaching includes a display panel 18. It is contemplated that this display panel 18 will include a buzzer 20 or other means for providing an audible signal, and a illuminated indicators 22, such flashing illuminated arrows or a Liquid Crystal Display (LCD) which provides the driver with visible instructions on the direction to pull off in order to allow an approaching emergency vehicle to pass safely. Thus, in the embodiment illustrated in FIG. 2 the display panel 18 includes a display screen 24 which can be used to provide information such as written instructions on the direction to pull over.

Also shown on FIG. 2 is that a buzzer 20 or other means for providing an audible alarm will preferably be included on the panel 18. The use of a buzzer 20 will be advantageous in that the disclosed system uses infrared signals to discern that an emergency vehicle is approaching. Under the appropriate conditions, the infrared signal may reach the private vehicle 10 before the siren of the emergency vehicle can actually be heard by the driver of the private vehicle 10.

Figure 3:
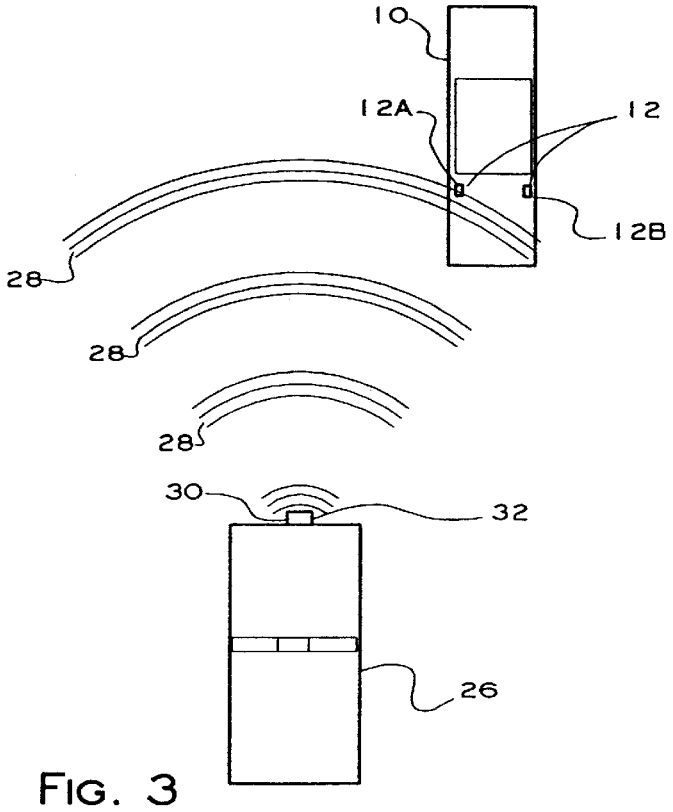
FIG. 3 is a plan view of a schematic illustrating the emission of identification and location signals from the emergency vehicle towards the private vehicle.

Turning now to FIG. 3 it will be understood that it is contemplated that the infrared transmitters and receivers 12 of the instant invention will be used to discover the safest direction to yield the right of way as well as the presence of the emergency vehicle 25. FIG. 3 illustrates that emergency vehicle 26 approaching the private vehicle 10. As the emergency vehicle 26 approaches the private vehicle 10 an identification signal 28 is delivered by the approaching emergency vehicle 26 by way of a transmitting means 30 for providing the identification signal 28, preferably form a single location 32 on the emergency vehicle 26.

According to a highly preferred embodiment of the invention the identification signal 28 will be pulsed at predetermined intervals. Because the pulsing will be at predetermined intervals, and the identification signal 28 will be sent from a single location 32 (at one time) from the emergency vehicle 26, the each of the transmitter and receivers 12 on the private vehicle 10 will receive the identification signal 28 at a different time. The difference in the time of reception for each of transmitters and receivers 12 can then be used to calculate the spatial relationship of the emergency vehicle 26 relative to the private vehicle 10. For example if receiver 12A receives the identification signal and then receiver 12B receives the identification signal, the system would be able to determine that the emergency vehicle is approaching on the right of the private vehicle 10, as shown on FIG. 3. Similarly, the rate of change of the difference in the time of perception of the individual pulses will also be used to determine the speed at which the emergency vehicle is approaching as well as the time until the two vehicles meet. The calculation of as to the speed of approach can be made by comparing the rate of change of the frequency identification signal as provided by the Doppler effect and the angle of approach of the emergency vehicle may then be calculated by using time difference in the perception of the pulses as defined by the geometry defined by the spacing between the receivers 12A and 12B and the distance to the emergency vehicle 26, since the difference in the time of arrival to each of the receivers 12A and 12B can be depends on the angle of approach of the emergency vehicle 26 relative to the private vehicle 10.

Figure 6:
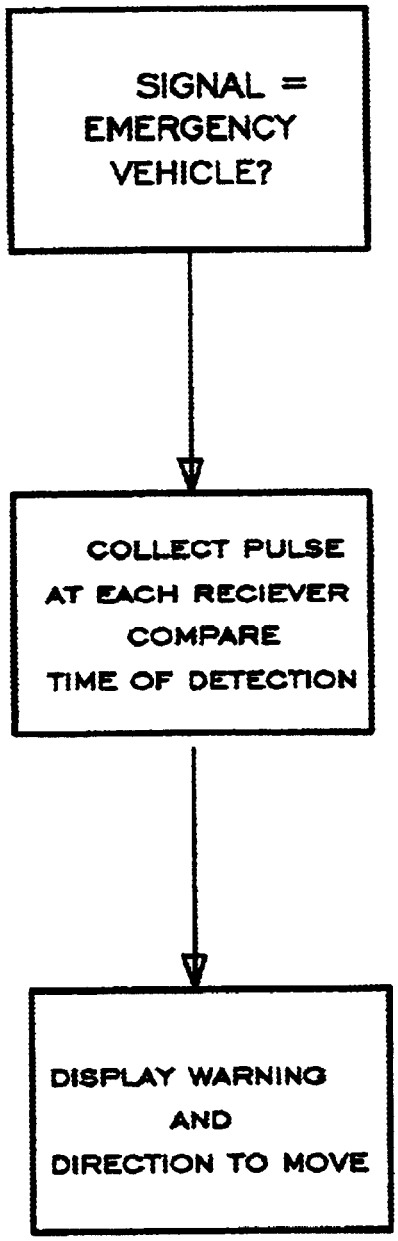
FIG. 6 is a flow diagram of the information processing to be carried out to collect and convey the information needed to inform the driver of the private vehicle of the direction to pull over in order to yield the right of way to the emergency vehicle.
Figure 7:
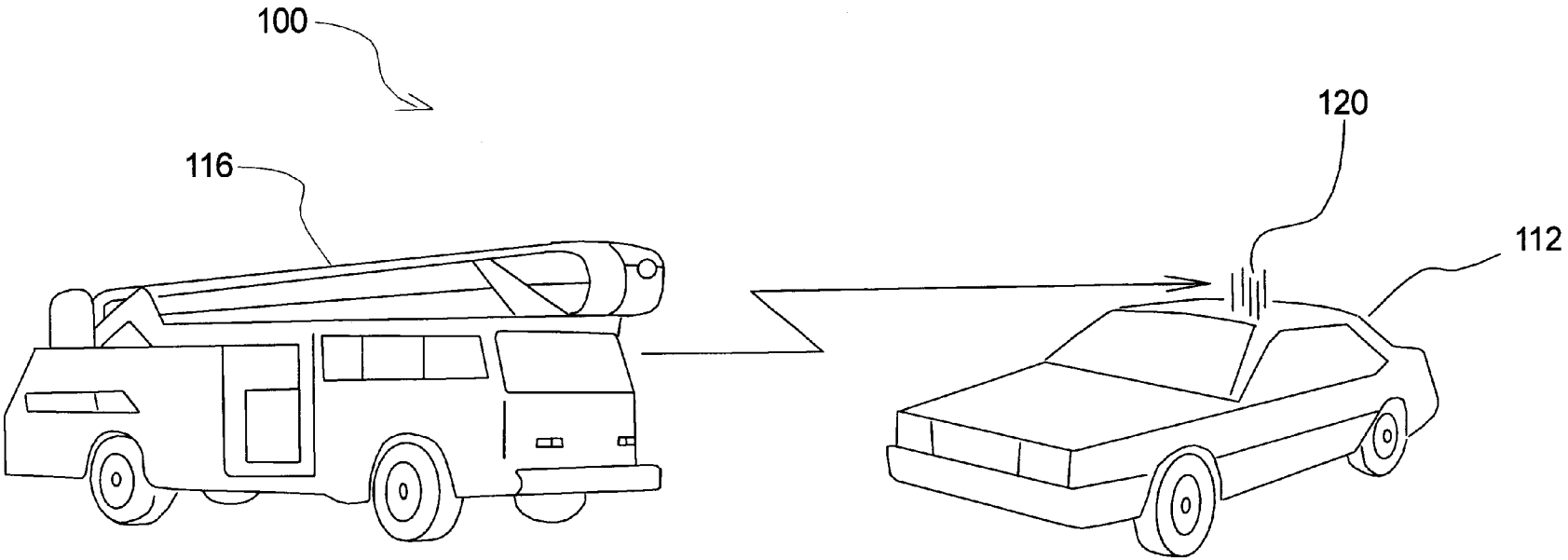
FIG. 7 illustrates the use of an example of an emergency vehicle warning system taught herein.
Figure 8:
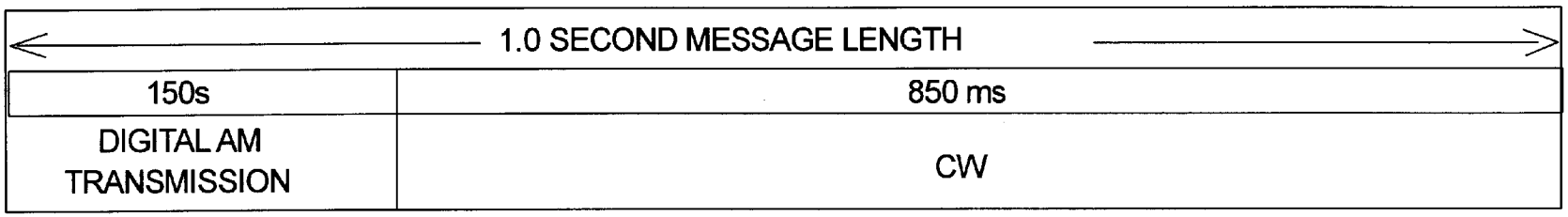
FIG. 8 illustrates a timing diagram for the message structure used in the transmitter.

Turning now to FIG. 6 it will be understood that signals detected by the receivers 12A and 12B may then be processing means for comparing a time of reception of the identification signal 28 between the receivers 12A and 12B. This information is then converted to useful information by a microprocessor or similar data processing device to activate the display means or panel 18. The panel 18 will be used to either display information on a screen 24. The information conveyed will allow the driver of the private vehicle 10 to make a decision as to the direction in which to move in order to yield to the emergency vehicle 26.

The identification signal transmitting means 30 permits the receiving system, which includes the infrared transmitters and receivers 12, to be used to identify that the approaching vehicle is an emergency vehicle. The infrared transmitters 12 on the private vehicle are used to deliver a signal that is reflected off of neighboring vehicles to allow the microprocessor to combine this information with the information as to the direction of approach of the emergency vehicle as derived from the identification signal 28 to guide the driver of the private vehicle 10 to a preferred route to yield the right of way.

Figure 4:
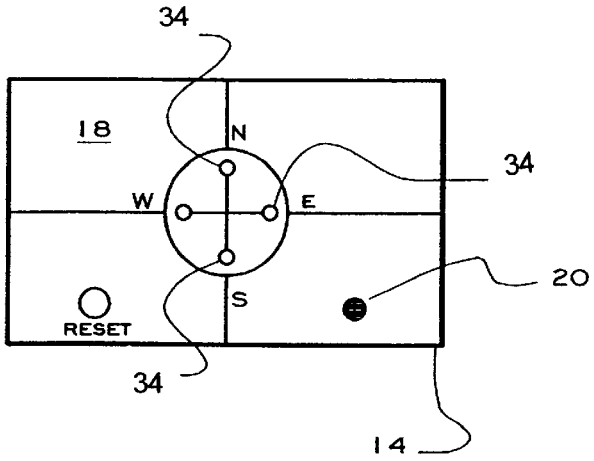
FIG. 4 shows an embodiment of the display panel of the console to be mounted in the private vehicle.
Figure 5:
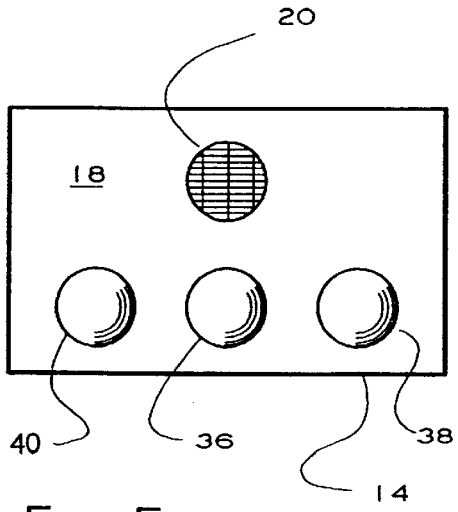
FIG. 5 shows yet another embodiment of the display panel of the console to be mounted in the private vehicle.

Turning now to FIGS. 4 and 5 it will be understood that contemplated variations in the display panel 18 include the use of the points of a compass 34 with illumination means at the points 34. These illumination means may then be used to warn the driver of the direction of approach of the emergency vehicle as well as the direction which should be taken to yield the right of way.

FIG. 5 illustrates yet another embodiment of the display panel 18, the display panel 18 includes a buzzer 20, a red light 36 to indicate that the driver should stop, an orange light 38 to indicate that the driver should proceed with caution, and a green light 40 to indicate that it is alright to proceed.

Another example of an Emergency Vehicle Warning System 100 has been illustrated in FIGS. 7 through 20. In this example a radio frequency (RF) based electronic system designed to alert motorists of the presence of a nearby emergency vehicle responding to an urgent situation. The emergency vehicle, using a specially designed transmitter 100, sends out a low power RF signal so that automobiles or private vehicles 112 in the area equipped with a companion receiver 114 can detect the presence of the emergency vehicle 116.

The motorist is alerted by an audio tone when the transmission is detected by their receiver. The approximate direction of the emergency vehicle from the motorist is then visually displayed by illuminating one of eight circularly positioned light emitting diodes (LEDs) on the receiver. The maximum operating range for the system is approximately 500 feet. The equipment is intended to be operated without a license under Part 15 of the FCC rules.

Transmitter Description

Figure 17:
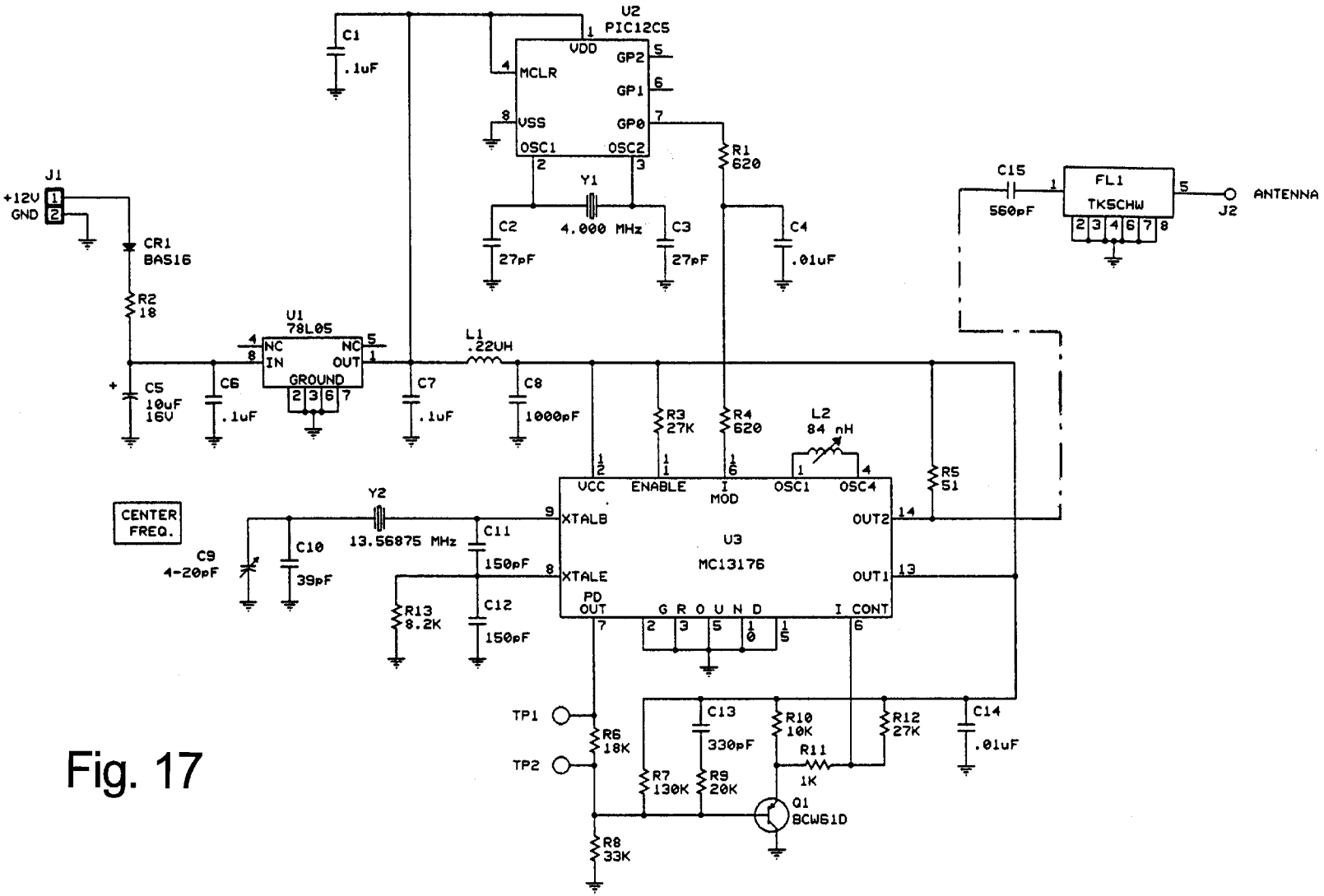
FIG. 17 is a schematic diagram of a direction finding antenna used with the disclosed invention.
Figure 18:
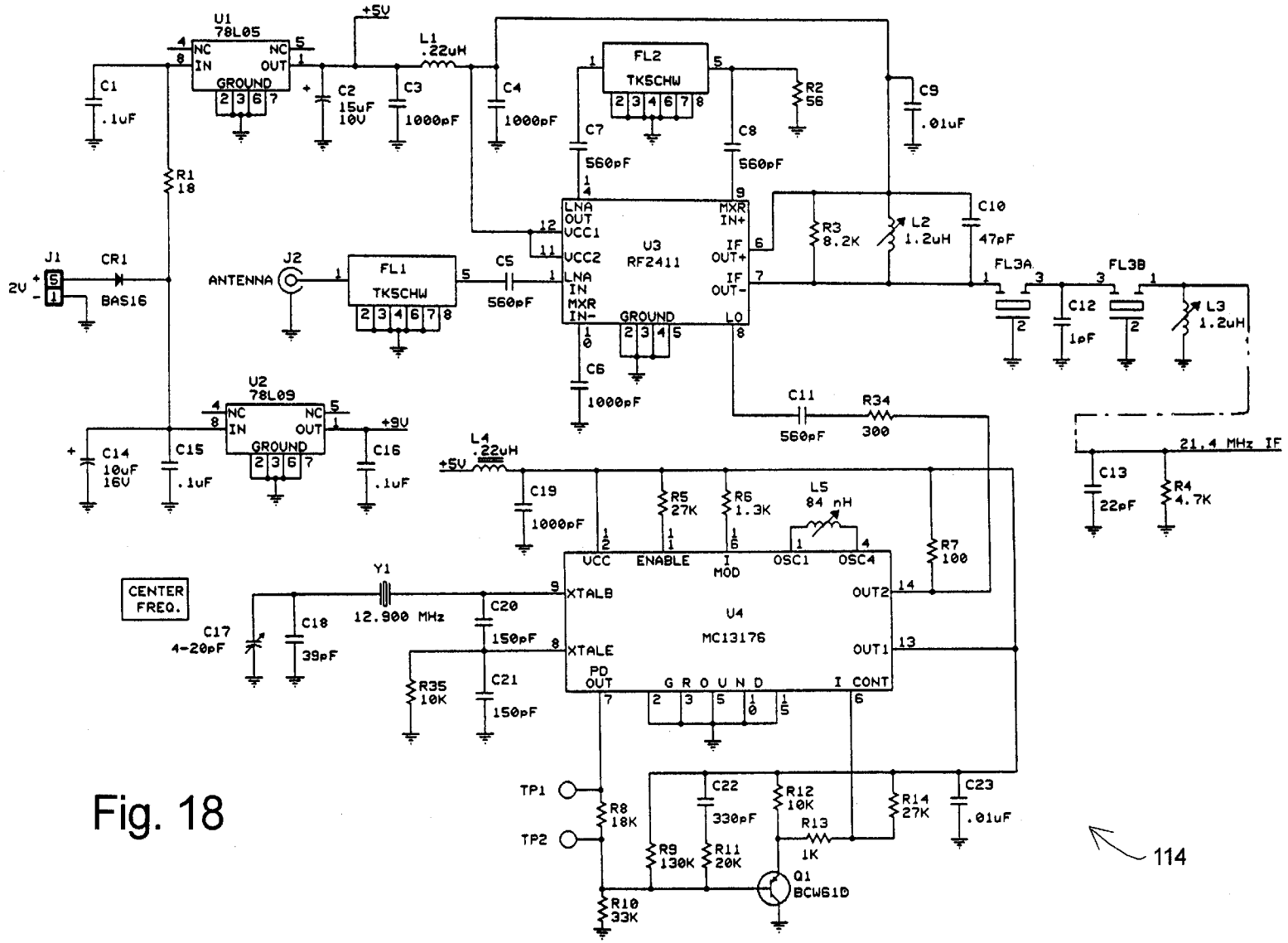
FIG. 18 is a schematic diagram of a direction finding transmitter used with the disclosed invention.

The transmitter 100, shown in detail in FIG. 17, operates on a fixed RF frequency in the UHF band. It is normally powered from the emergency vehicle's battery, and begins transmitting as soon as it is energized. According to FCC rules, the transmitter may be operated continuously during the emergency condition. The transmitted signal consists of a one second message that is constantly repeated. The message comprises a 150 ms (milliseconds) digital recognition code followed by a period of unmodulated carrier (CW). Using digital AM modulation, the recognition code uniquely identifies the transmission as part of the Emergency Vehicle Warning System. The CW portion of the transmission lasts for 850 ms, to permit the receiver to measure the direction of the transmitted signal. A digital microcontroller, located internal to the transmitter, generates the transmitted message. The timing diagram of the message structure may be understood with reference to FIG. 8.

Receiver/Antenna Description

Figure 9:
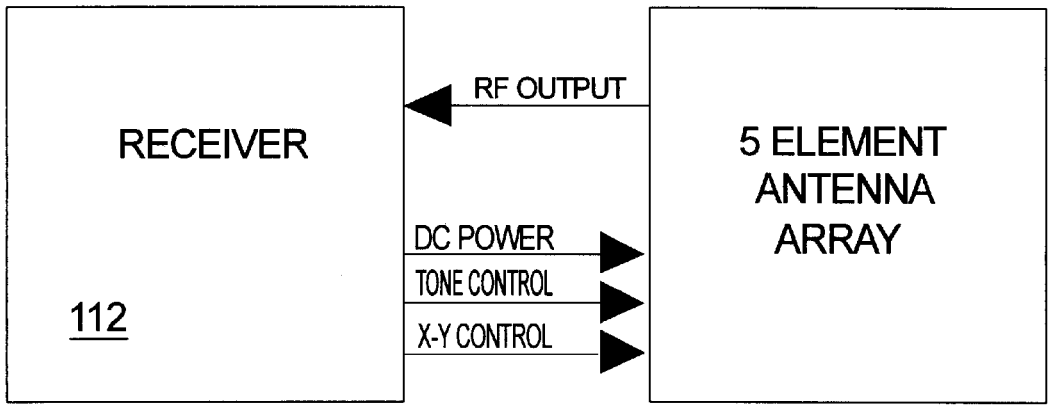
FIG. 9 is a block diagram of the receiver/antenna interface of the system illustrated in FIG. 7.
Figure 10:
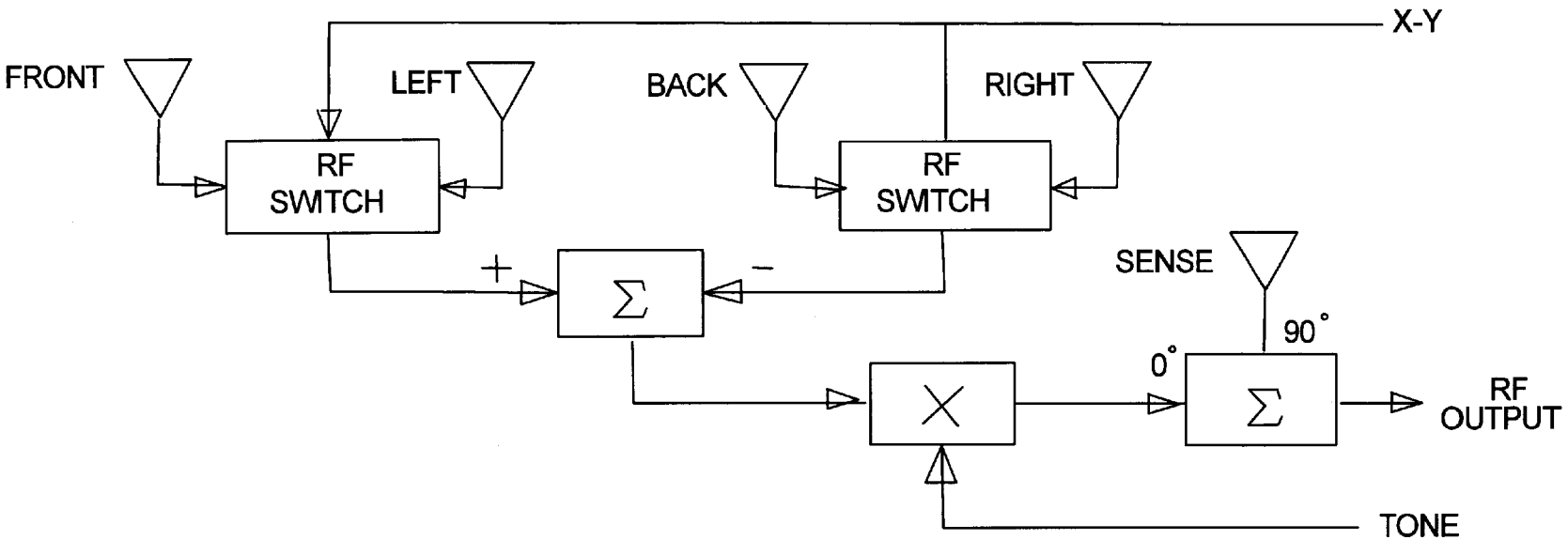
FIG. 10 is a block diagram of the receiver antenna arrangement.
Figure 11:
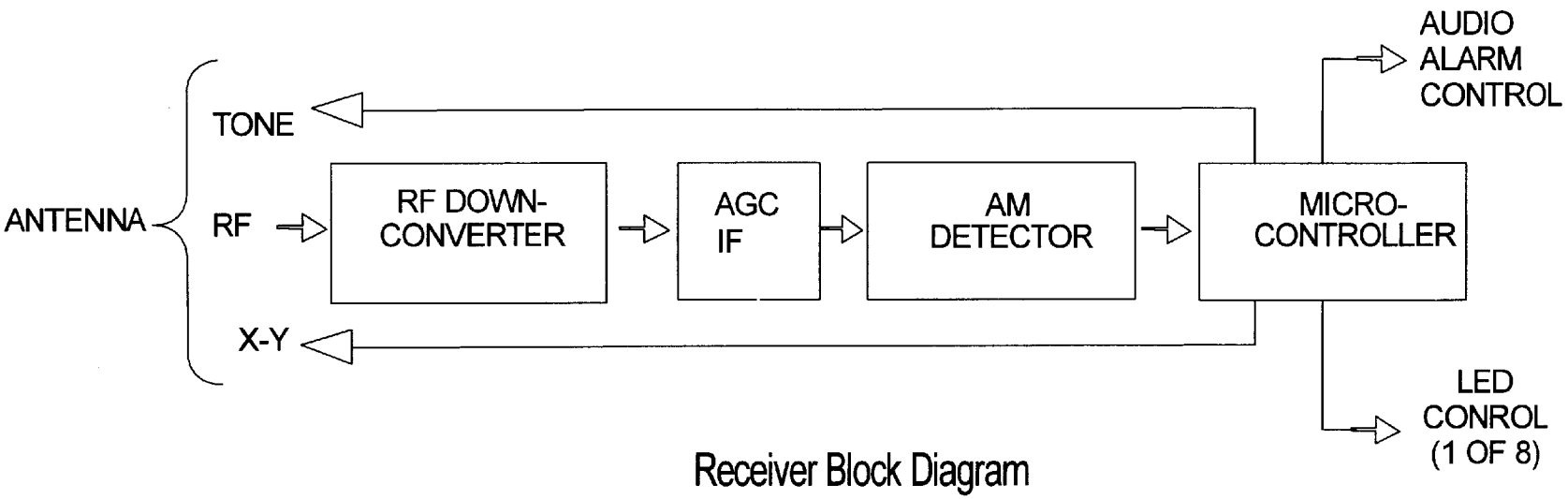
FIG. 11 is a block diagram of the receiver arrangement.
Figure 16:
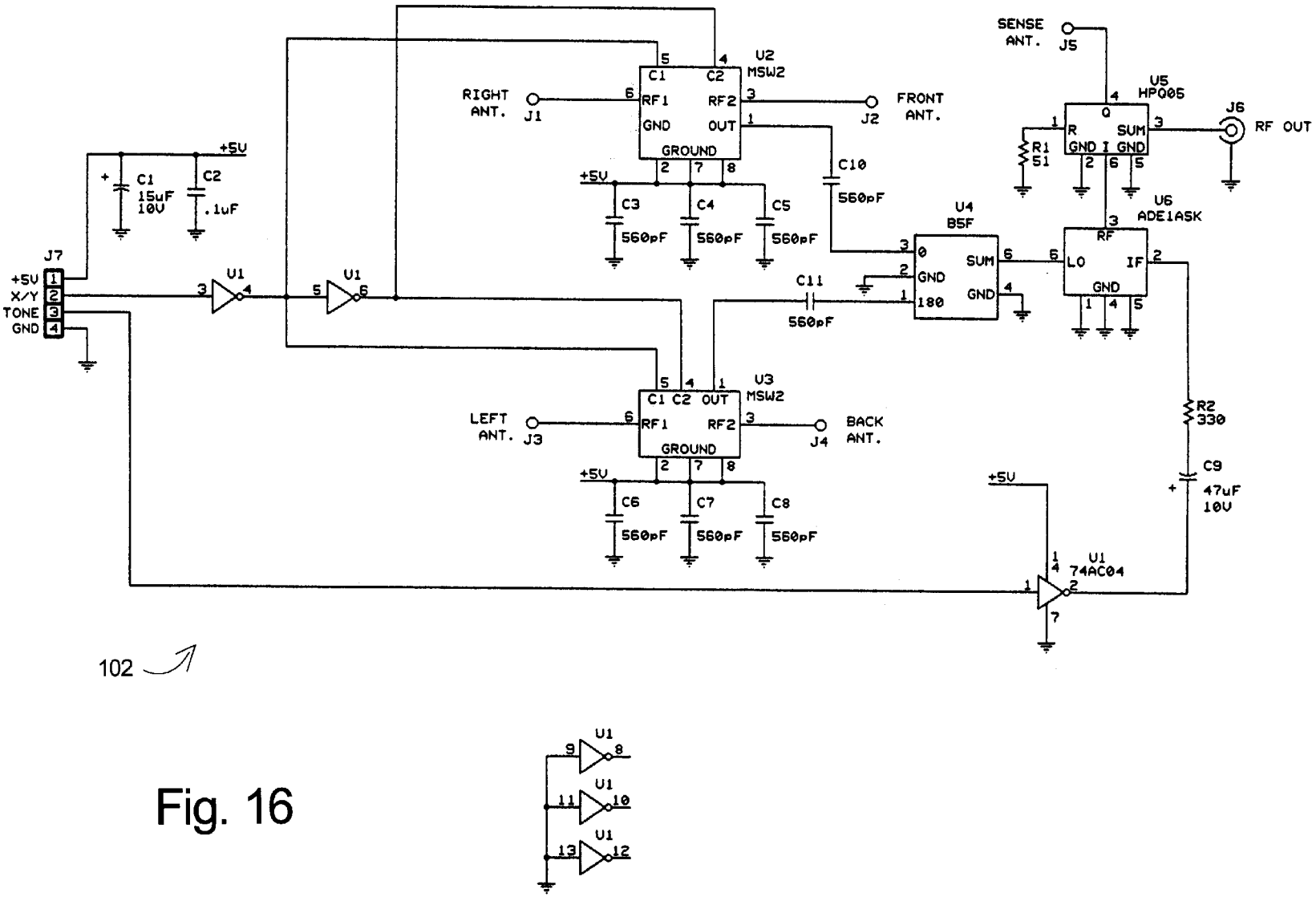
FIG. 16 is a schematic diagram of further details of the direction finding receiver shown in FIG. 15.

The receiver is located in the motorist's vehicle or private vehicle 112 and operates together with a direction finding antenna 120 mounted on the roof. Interconnecting cables between the receiver and antenna are used to route the received signal output and control signal inputs. FIG. 9 is a block diagram of the receiver/antenna interface. FIG. 16 shows detailed structure of the direction finding antenna. Normally, when no emergency transmission is present, the receiver is constantly listening for the beginning of a transmission from the emergency vehicle. A digital microcontroller performs this function. During this period, the antenna is configured as an omni-directional monopole to permit equal reception from all directions.

After the AM recognition code is successfully detected, the antenna is configured for Y-direction measurement (front-back) and then for X-direction measurement (left-right) during the remainder of the one second transmission. A low frequency, square-wave tone signal is generated by the receiver to effectively produce AM modulation on the received CW carrier and enable directional information to be extracted from the emergency transmission. The antenna then reverts back to the message reception mode, repeating the cycle continuously.

Because the receiver/antenna system is designed to operate only with the expected signal format of the emergency transmitter, it essentially synchronizes itself with it. This minimizes false alarms and allows direction measurements to be performed only while a valid signal is present.

3.0 Antenna Description

FIG. 16 shows details of the receiver antenna 102, which consists of a five element Adcock array. Two elements are used for X-directional measurement, two for Y-directional measurement and one for "sense" measurement. The sense antenna, located in the center of the array, is used for omni-directional message reception and to resolve the 1800 ambiguity that would otherwise result during direction measurement. The antenna system operates under control of the receiver, via interconnecting cables.

While the receiver is listening for a valid recognition code, the TONE input is disabled, effectively disabling the multiplier. Under this condition, RF signals from the sense antenna only are fed to the receiver. During Y-direction measurement, the X-Y control input configures the RF switches to select the front and back antennas, forming a Y-axis dipole antenna pattern. While the Y-axis antennas are selected, a 1 KHz square wave TONE signal is generated which in turn produces a double-sideband suppressed carrier AM signal at the output of the multiplier. The output of the sense antenna is added in quadrature to produce a conventional AM modulated signal. The percentage and polarity of the AM signal are directly related to the direction of the incident RF signal from the emergency transmitter. Alternately, when the polarity of the X-Y control signal is reversed, the left and right antennas are selected, permitting direction finding in the X-axis.

4.0 Receiver Description

FIGS. 10, 11, 15 and 18 show that a single frequency, superhetrodyne AM receiver 112 is used. It processes recognition decoding and direction finding signals using the same circuitry. An integrated circuit microcontroller performs the timing, control, and direction processing functions.

Automatic gain control (AGC) of the iF stages is necessary to maintain the amplitude linearity required to properly demodulate the AM signals over wide input signal variations. The choice of AGC time constant is a compromise between response time and signal distortion. A fast acting AGO is desirable in order to track rapidly changing RF signal levels. However, if the response time is too quick, the desired AM signals will be "tracked out", causing loss of information. A response time of approximately 50 ms is a reasonable compromise.

Figure 12:
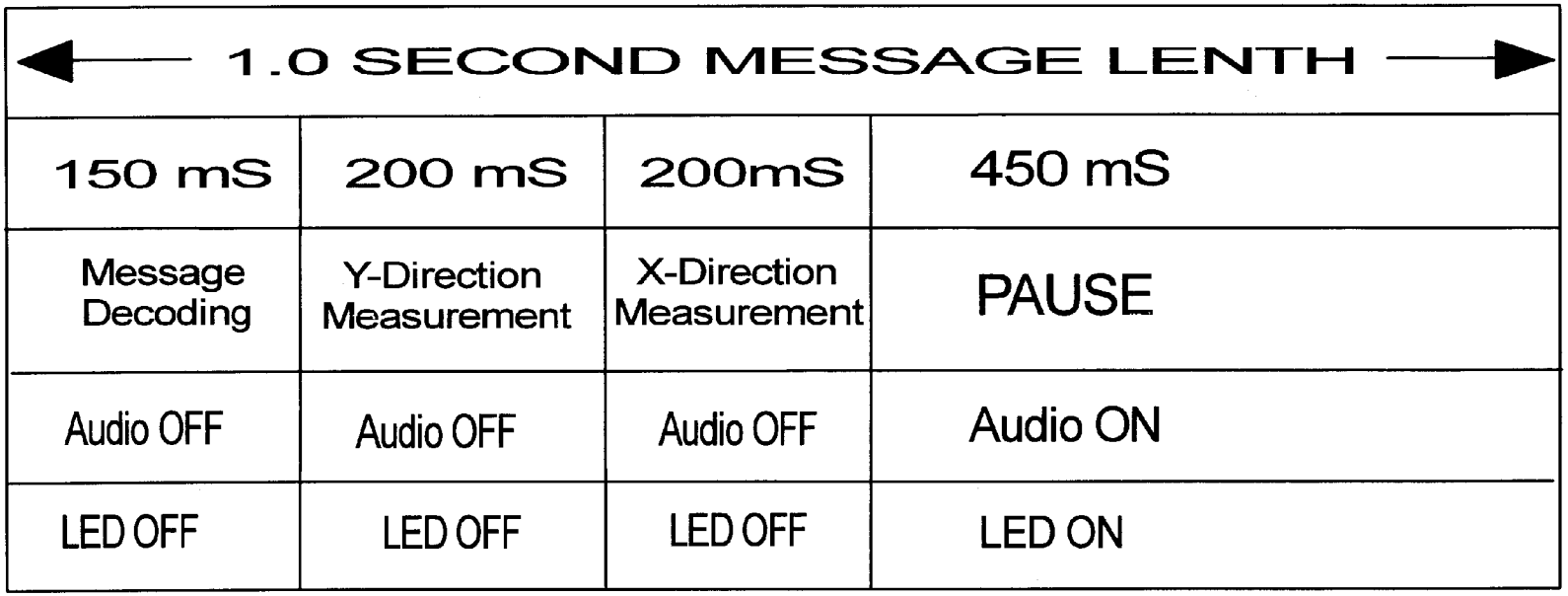
FIG. 12 is illustrates the sequence of events during message processing.
Figure 13:
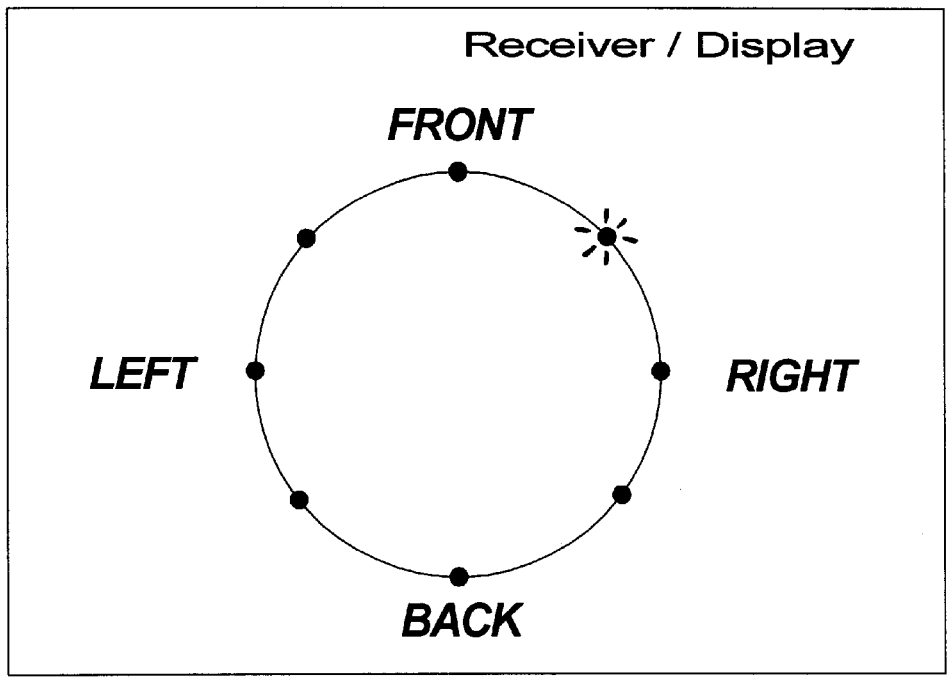
FIG. 13 illustrates an example of the use of LEDs to provide direction information relating to the direction of approach of the emergency vehicle.
Figure 15:
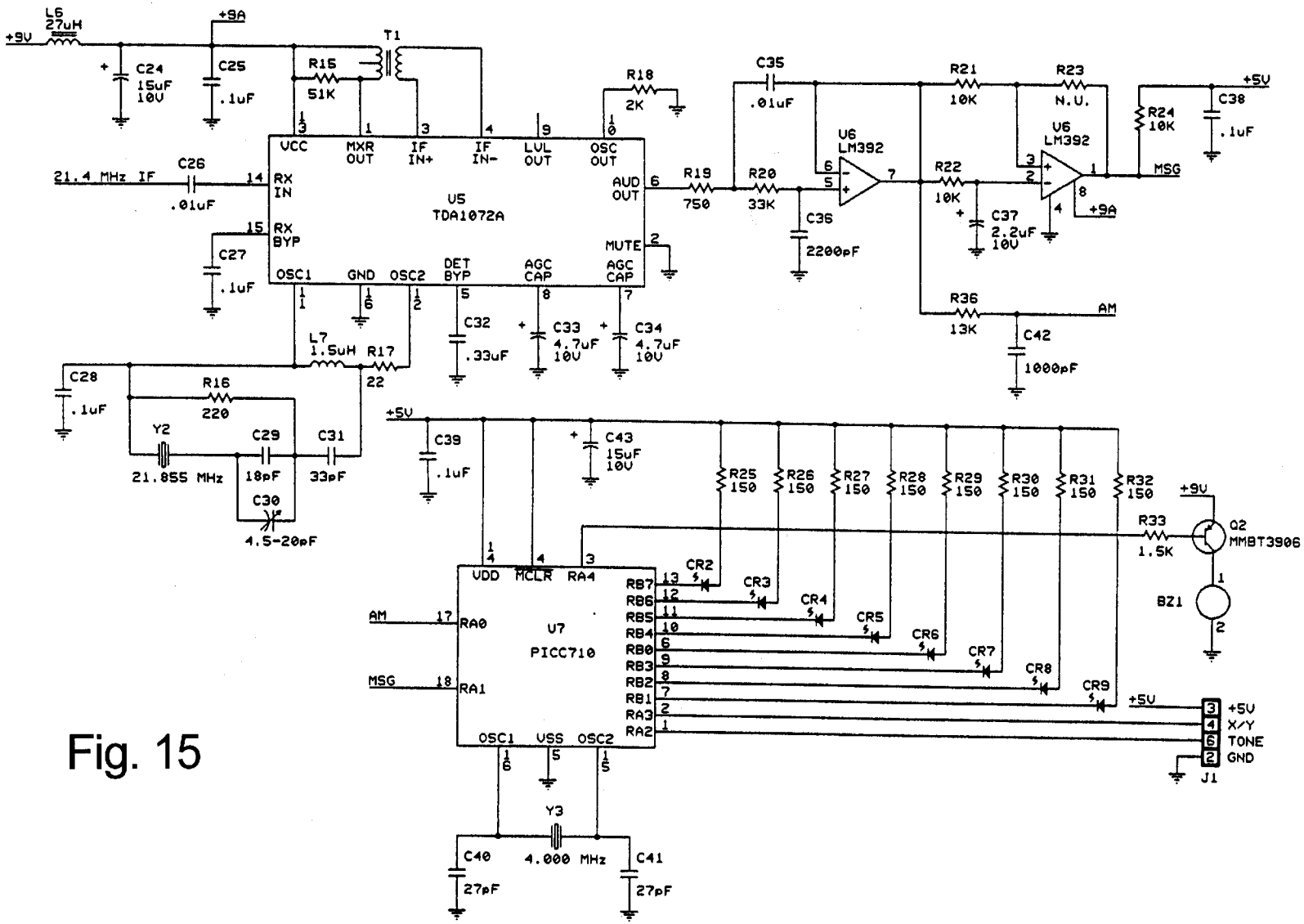
FIG. 15 is a schematic diagram of a direction finding receiver used with the disclosed invention.

As mentioned earlier, the receiver's microcontroller is designed to detect and demodulate the emergency transmitter signal. In the absence of an input signal, the receiver is constantly examining the AM detector output for the presence of a start bit, indicating the beginning of a valid transmission. When the recognition code has been successfully received, the direction finding processing begins. Then, the audio alarm is activated and the appropriate LED is illuminated to indicate the approximate direction of the emergency vehicle from the motorist. At the end of each message, the audio and LED indications are turned off until the next repeated message is processed. In this manner the audio beeps and the LED blinks. FIG. 12 describes the sequence of events during the processing of each transmission.

An analog to digital converter (A/D) in the receiver microcontroller measures the detected AM voltages during the OW portion of the transmitted message and performs the averaging and signal level comparisons necessary to predict the approximate direction of the emergency transmitter. One of the eight possible LEDs will be lit as a result of this measurement.

The results of the direction finding measurements can be summarized in a table that indicates how one of the eight LEDs is illuminated as a function of the X and Y AM levels and polarities. FIG. 14 illustrates such a table.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. An emergency vehicle warning system for informing a driver in a private vehicle that an emergency vehicle is approaching and providing the driver of the private vehicle with information on the direction to move the private vehicle in order to allow the emergency vehicle to pass the private vehicle, the system comprising:

a private vehicle mounted receiving system comprising of:

an antenna consisting of five monopole components for receiving an identification signal from the emergency vehicle;

a display for informing the driver of the private vehicle of the approach of an emergency vehicle and means for informing the driver of the private vehicle of the direction to move in order to yield to the emergency vehicle; and an identification signal transmitter for providing the identification signal, so that the receiving system identifies that the approaching vehicle is an emergency vehicle and determines the direction of approach of the emergency vehicle through a time difference between receipt of the identification signals.

2. A system according to claim 1 wherein said display means comprises a console having a warning buzzer and indicator lights for indicating the direction to be taken in yielding the right of way.

3. A system according to claim 1 and further comprising an infrared transmitter, the infrared transmitter being connected to be activated by the receiver means, so that the position of adjacent vehicles is determined to determine the direction to move the private vehicle in order to yield the right of way to the emergency vehicle.

4. A system according to claim 1 wherein said transmitter is at a single location on the emergency vehicle.

5. A system according to claim 1 wherein said identification signal is a pulsed signal.

6. A system according to claim 5 wherein said pulsed signal is an infrared frequency signal.

* * * * *